US006241320B1

(12) United States Patent
Chew et al.

(10) Patent No.: US 6,241,320 B1
(45) Date of Patent: Jun. 5, 2001

(54) CUSTOMIZABLE SEAT CUSHION AND POSITIONING ASSEMBLY INCLUDING PRESSURE COMPENSATION INSERTS

(75) Inventors: Norman Chew, Toronto; Nenad Medjedovic, Aurora, both of (CA)

(73) Assignee: Invacare Corporation, Elyria, OH (US)

( * ) Notice: Subject to any disclaimer, the term of this patent is extended or adjusted under 35 U.S.C. 154(b) by 0 days.

(21) Appl. No.: 09/418,783

(22) Filed: Oct. 15, 1999

(51) Int. Cl.[7] ..... A47C 7/02
(52) U.S. Cl. ..... 297/452.26; 297/452.41
(58) Field of Search ..... 297/452.41, 452.48, 297/452.33, 452.22, 452.21, 452.26, 284.1, DIG. 1, DIG. 4; 5/630, 652, 654, 655.5, 909

(56) References Cited

U.S. PATENT DOCUMENTS

| | | | |
|---|---|---|---|
| 2,987,735 | * | 6/1961 | Nail . |
| 3,000,020 | | 9/1961 | Lombard et al. . |
| 4,588,229 | | 5/1986 | Jay . |
| 4,646,374 | | 3/1987 | Shafer . |
| 4,699,427 | | 10/1987 | Kobayashi . |
| 4,761,843 | | 8/1988 | Jay . |
| 4,837,881 | | 6/1989 | Kondo et al. . |
| 4,842,330 | | 6/1989 | Jay . |
| 4,951,334 | | 8/1990 | Maier . |
| 5,018,790 | | 5/1991 | Jay . |
| 5,189,747 | | 3/1993 | Mundy et al. . |
| 5,303,436 | | 4/1994 | Dinsmoor, III et al. . |
| 5,333,921 | | 8/1994 | Dinsmoor, III . |
| 5,378,045 | | 1/1995 | Siekman et al. . |
| 5,390,384 | | 2/1995 | Dinsmoor, III et al. . |
| 5,395,162 | | 3/1995 | Jay et al. . |
| 5,397,517 | | 3/1995 | Jay et al. . |
| 5,490,299 | | 2/1996 | Dinsmoor, III et al. . |
| 5,522,106 | | 6/1996 | Harrison et al. . |
| 5,687,436 | | 11/1997 | Denton . |
| 5,836,654 | | 11/1998 | DeBellis et al. . |
| 5,839,140 | | 11/1998 | Wilkerson . |
| 5,918,334 | | 7/1999 | Laidlaw . |
| B1 4,726,624 | | 11/1993 | Jay . |

FOREIGN PATENT DOCUMENTS

| | | |
|---|---|---|
| WO 97/45039 | 12/1997 | (WO) . |
| WO 99/42070 | 8/1999 | (WO) . |

* cited by examiner

*Primary Examiner*—Milton Nelson, Jr.
(74) *Attorney, Agent, or Firm*—Hudak & Shunk Co., L.P.A.; Laura F. Shunk

(57) ABSTRACT

The device relates generally to a seating system and more particularly to seat cushion assemblies having a rearward depression and cushioning insert tailored to fit under the skeletal structure of the user. In particular, the assembly preferably includes an intermediate insert which fits within a base depression and a cushioning insert which can be a fluid bag, air bag, foam or gel. The insert is generally oval shaped and has a rounded bottom. This enables the cushion to be used to fit under the seating bones so as to provide a proper pelvic tilt. Further, the insert can be moved in order to provide controlled movement of the pelvis over time. A first cushioning insert is generally constructed of a material forming baffles so as to define air chambers and having a right and left seat bone area.

A second design has a top and bottom so as to define the fluid envelope separated by a central baffle having apertures to allow fluid communication between the right an left portions.

In a further aspect, the device includes tapered wedges which can be removed to lower one side of the leg well and the base cushion to allow for self-proportion on the part of the user. Rigid stabilizers support the edges of the base cushion.

14 Claims, 8 Drawing Sheets

FIG.-9
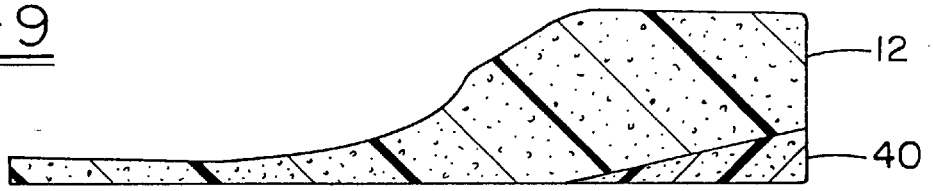
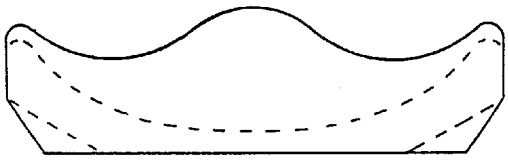
FIG.-10
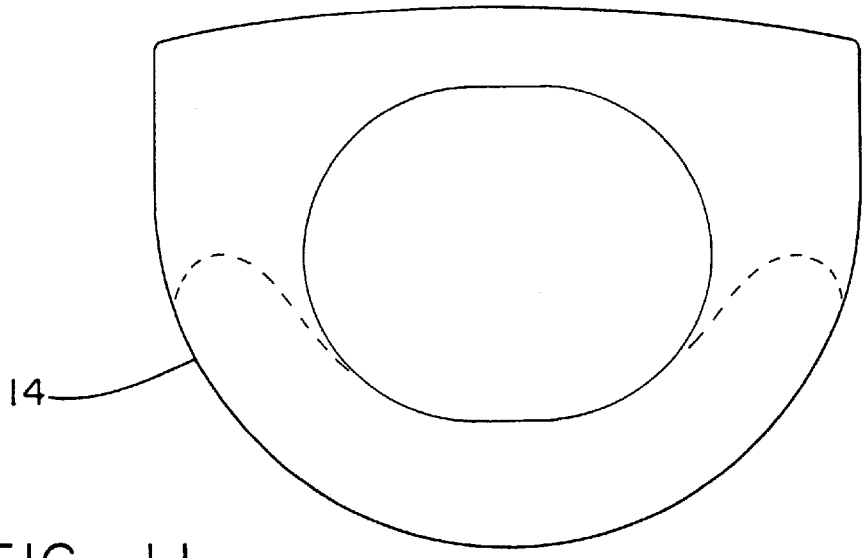
FIG.-11
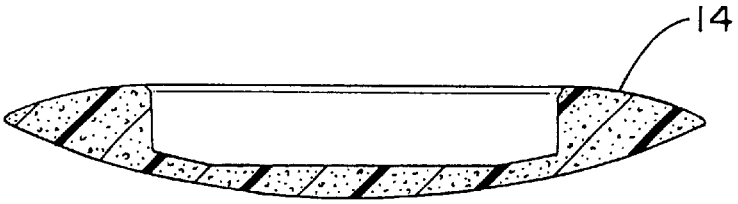
FIG.-12

CUSTOMIZABLE SEAT CUSHION AND POSITIONING ASSEMBLY INCLUDING PRESSURE COMPENSATION INSERTS

FIELD OF THE INVENTION

The invention relates generally to a sitting systems, and more particularly to seat cushion assemblies which can be tailored to fit the needs of individuals who use wheelchairs.

BACKGROUND OF THE INVENTION

The art of seating has grown to a science involving considerations of physiology, material science, and ergonomics. Wheelchair seating systems have their own particular criteria which will be dictated to some extent by the type of disability of the user. The present invention relates to a seating assembly designed specifically for wheelchair use and which can be tailored to fit the individual needs of a user. While the present invention encompasses multiple aspects, overall goals include maintenance of good health, and comfort of the user. The present invention provides a unique approach and features to posture correction and further services the goal of minimizing the risk of decubitus ulcers. A further aspect of the invention is the provision of a seating system which can be customized, or semi-customized from standard component parts. As an element of this aspect of the invention, the seating assembly can accommodate paddling (i.e. or the ability to utilize one leg to propel the wheelchair.)

A first aspect of the invention provides a foam base cushion which is firm but compressible such as provided by an open or closed cell polyurethane foam. The base has a rear depression which is situated to fit under the user's bottom including ischial tuberosities (i.e. the seat bones) as well as the trocantors of the person seated on the cushion (i.e., "the user"). In a preferred embodiment, the depression is bowl shaped, having smoothly spherical or concave surface with the lowest point under and between the ischial tuberosities and which rises gradually upwardly from a gently rounded bottom and blends with the surface of the cushion. The depression may be hemispherical or may be elongated in the direction of the width of the chair so as to form an ovoid or elliptical shape. The rear depression cradles an intermediate insert which acts to position the user by supporting the trocantors. The seat bones are ultimately supported by a top compression insert which fits in a well in the intermediate insert. As the user's trocantors are positioned on the intermediate insert, a novel method of positioning is provided in which the skeletal structure of the user is positioned rather than using the prior art reliance on soft tissue. Thus, the present invention provides the advantage of avoiding reliance on soft tissue as a seating support since, in many people who use wheelchairs, the quality and consistency of the muscular tissue is poor.

In a further aspect of the invention, the intermediate insert is provided having a top surface which defines a seating well. The insert can include a bottom surface which corresponds to the contour of the top surface so as to give it the appearance of a thick foam bowl, or alternatively may have a relatively planar bottom joined to sloping or even vertical sidewalls. In this embodiment, the intermediate insert meets with an opening (i.e., the depression) in the rear of the cushion. The opening or depression may have a number of configurations including hemispherical, elliptical, cylindrical, or any of the above being open to the back so as to form a gentle U-shape. The intermediate insert may be made of a material which has the same compression characteristics as the base cushion or may have stiffer or softer characteristics. The insert is preferably a viscoelastic polyurethane foam. The insert includes means to affix the insert to the base cushion such as for example adhesive or hook and loop fasteners. The use of the intermediate insert enables a positioning which can be tailored for a particular user. For example, when a user has a scoliosis causing a lateral asymmetry in the pelvic region, the depression can be angled to accommodate or to correct for the problem. This angle can be infinitely adjusted within the adjustment over time to fit the individual user. The intermediate insert preferably includes a seating well for a compression insert.

Transverse lateral stabilizers are provided on the bottom side of the cushion and can comprise elongated wedge members having a generally triangular cross-section which support the outer side edges of the cushion from the bottom. The lateral stabilizers or wedges are generally constructed of a material which is stiffer, or more rigid than the base cushion such as closed cell polyurethane foam. Otherwise, the bottom side of the cushion is relatively flat so as to correspond to the shape of a base support of the wheelchair or a rigidizer member which provides a planar surface for sling seats.

In a separate embodiment, the cushion may optionally include two mating leg wedges which together compliment the bottom or top side which slope gradually in thickness from a thick front end (i.e. of 0.75 to 1.5 inches) to a thinner rear (i.e. from 0 to 0.25 inches) end. Generally speaking, the transverse dimension, i.e. across the width of the seat, is maintained the same. Optionally, the cushion may be split in the center thus, when one leg wedge is removed, the top surface of the base cushion slopes slightly downward so as to drop the leg and enable the user to self-propel or paddle with the lower leg.

The top surface of the base cushion optionally includes contouring such as elevated sides, a front pommel, and ridge so as to define leg wells and rear rims to provide further support to the soft tissue of the user's bottom.

As a further aspect of the invention, a variety of optional compression inserts are used in the rear depression. An insert is located in the rear seating well so as to give a therapist the option of using the insert to accommodate and/or compensate the user's needs.

All of the inserts generally have a bottom contour corresponding in shape to the rear depression of the cushion. The inserts may be comprised of foam, gel, fluid and/or air either alone or in combination. The top surface of the inserts are generally flat with cushioning characteristics but having the ability to maintain a gross contour so as to provide positioning support to the skeletal structure of the user. One insert is a fluid bag shaped like a shallow round or oval pad such as for example, a large powder puff or cosmetic pad. The insert has a central baffle having openings to allow fluid communication between a first and second compartment. The central baffle generally divides the bag in half although it is not critical and may not be desirable that the baffle is located so as to divide the bag symmetrically about an axis transverse to the longitudinal axis of the bag (i.e. the seam does not need to run at a 90° angle from the front of the bag to the back of the bag, but rather may be oblique with respect to that axis). The fluid bag further is preferably made of one or more layers of an extensible elastomeric material which are heat sealed on the sides and including the baffle of a similar material heat sealed to the top of at least one layer of the outer top envelope material and at least one layer of the outer bottom elastomeric material. Suitable fluid material such as for example, Invaflow® or Flowlite® may be used in the insert or fluid bag. The material should have a characteristic of flowing under pressure but substantially maintaining its shape in the absence of pressure.

In an alternative embodiment, an air insert is provided which comprises a flexible elastomeric material forming a series of channels for air (other gases, or other suitable fluid materials). Optionally, the channels may be formed in the top surface or bottom surface of the insert although in a preferred embodiment, the channels are formed in both the top and bottom surface with intermediate walls being formed by heat sealing the top to the bottom such as by heat sealing or otherwise adhering the top to the bottom. These channels are broadly interconnected and symmetrical on the right and left side. Optionally, the compression characteristics can be changed in the pad in order to provide stiffer compression on one side or at one location or another on the bag.

A third insert is a foam pad having compression characteristics appropriate for the user i.e., being either stiffer or softer depending on the amount of compression that is needed. This insert generally has a relatively simple powder puff shape with a bottom contour corresponding roughly to the contour of the rear depression.

A fourth version of the insert has a shape similar to the foam shape but being made of gel, or foam and gel so as to provide a composite having desirable compression characteristics. In particular, a foam base having substantially upright/channels may have an over layer or top layer of gel. Inserts may be any design, shape, material or combinations of materials suitable for the purposes of providing position support to the skeletal structure of the user.

BRIEF DESCRIPTION OF THE DRAWINGS

FIG. 9 is a cross-section illustrating the base cushion;

FIG. 10 is a rear view of the base cushion;

FIG. 11 is a top view of the intermediate insert;

FIG. 12 is a cross-section of the intermediate insert;

DETAILED DESCRIPTION OF THE INVENTION

Figure 1:
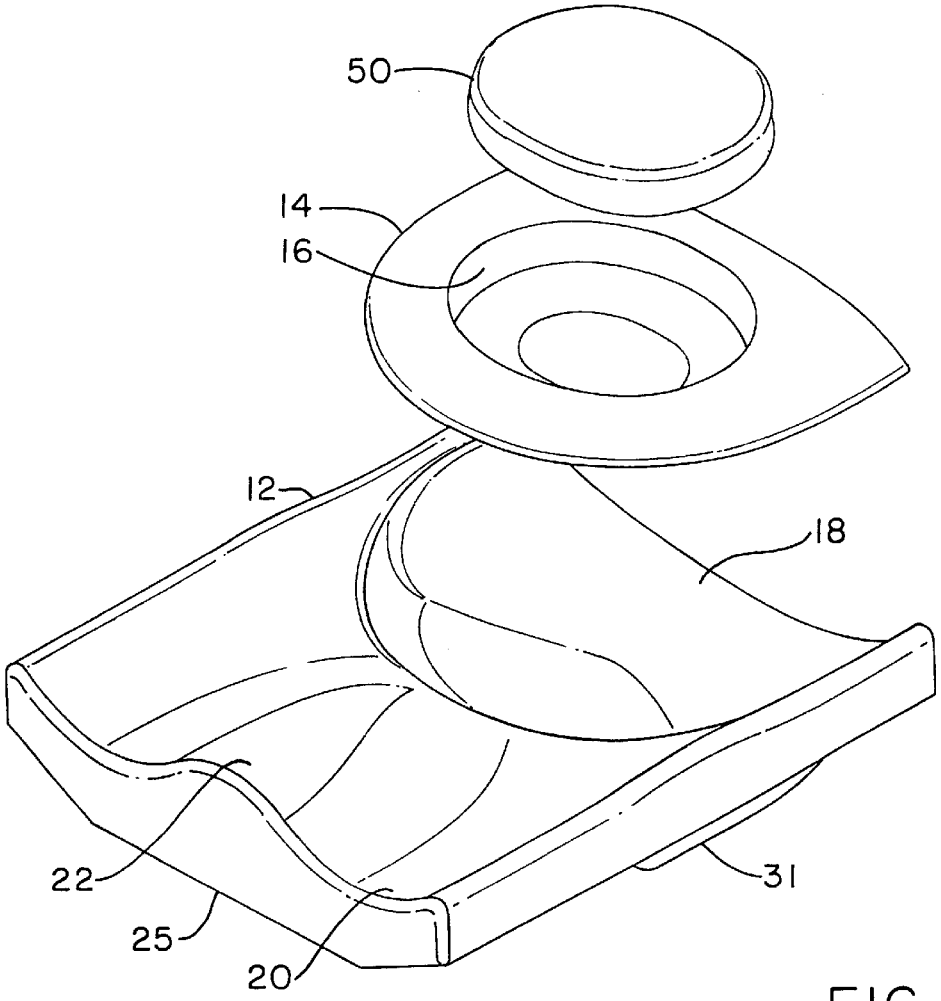
FIG. 1 is an expanded view of cushion assembly in accordance with the invention.
Figure 2:
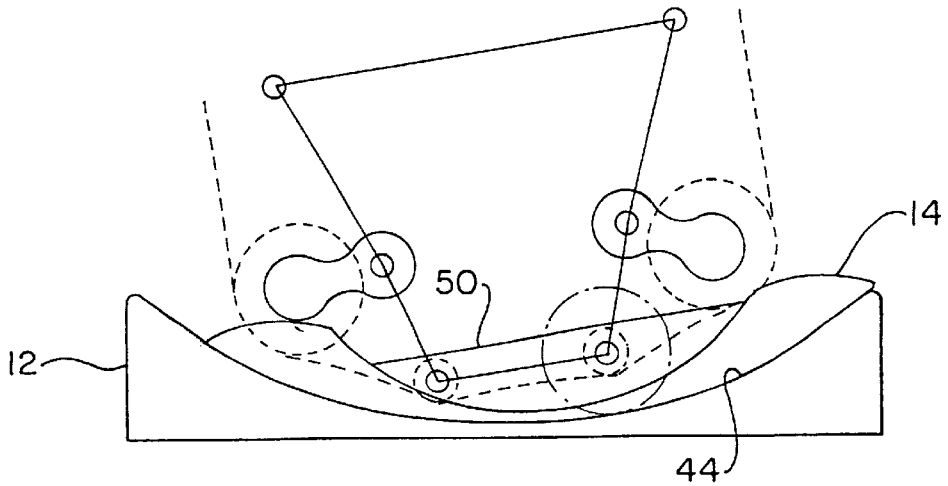
FIG. 2 is a cross-section of the assembly illustrating a first position of the cushioning insert for positioning a user's seat bones.
Figure 3:
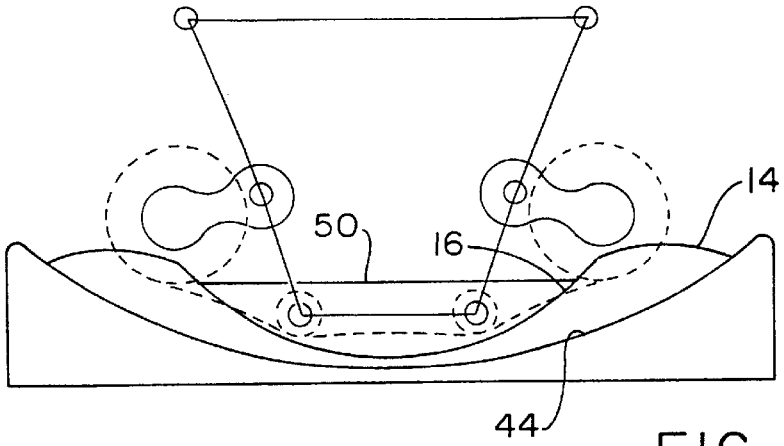
FIG. 3 is a second position of the cushioning insert showing the positioning of the user's seat bones.

FIG. 1 represents an exploded view of the cushion assembly in accordance with the invention. The cushion assembly 10 generally comprises a base member 12 and insert 14 having on its top surface a position well 16. The base member 12 similarly has an open depression 18 which cradles the intermediate insert 14. Also on its top surface, base number 12 includes laterally symmetrical channels 20 which are generally mirror images of one another and which are formed to cradle the legs of a person seated in the wheelchair. Thus, the channels are generally in the forward facing portion of the seat relative to the opening of the chair. The channels together define an intermediate rise or pummel which acts to maintain the position of the leg on either side of a central longitudinal axis of the base cushion. As can bee seen from the cross-section of the assembly, the base cushion also includes a relatively planar bottom surface 24, which is seated on a flat surface of a wheelchair such as a seat base, or on a rigidizer insert in the event that a cushion is used with a sling-type wheelchair. The base cushion member 12 is also formed so as to include angled lateral ledges which mate with corresponding lateral stabilizers 30–31, which are generally wedge shaped and increase in height toward the outer edge of the chair, i.e. in a direction transverse to the longitudinal axis of the cushion. The wedges have a generally constant cross-section in the longitudinal direction. These wedges may run the length of the cushion or be provided in two sections to allow clearance of the cross braces.

As will be discussed in more detail, the cushion is made of a relatively compressible material such as for example closed cell polyurethane foam having a density of about 1–5 pounds per foot$^3$ and a IFD of 20–70 pounds. In contrast, the lateral stabilizers are made from a relatively incompressible material such as for example rigid polyethylene, although other materials could be used.

In a separate aspect of the invention, the cushion can include leg wedge members 40–41. These wedges have a gentle taper in the longitudinal direction so that they are thickest, having a depth of about 0.5 to about 2.0 inches at the front end, and a depth of about 0 to about 0.25 inch at the rear end. The lateral cross-section, i.e. across the width of the chair, is generally held constant. These leg wedges can be placed on top of the cushion above the channels 20 or can be placed below the cushion at the forward portion of the planar surface 25. The wedges are provided to enable a variation in height from the left channel to the right channel to allow the option of dropping one leg for user to allow "paddling" or self-propulsion using a single leg. In conjunction with this, the base cushion can include a central split 43 in the pummel 22 which facilitates the lowering of one leg.

Figure 4:
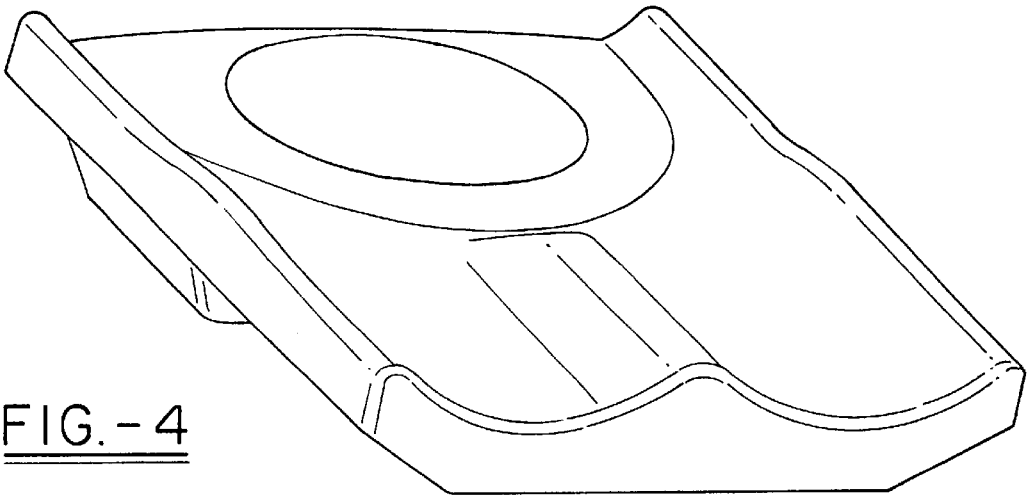
FIG. 4 is a top view of a first embodiment of a cushion assembly in accordance with insert (the air)
Figure 5:
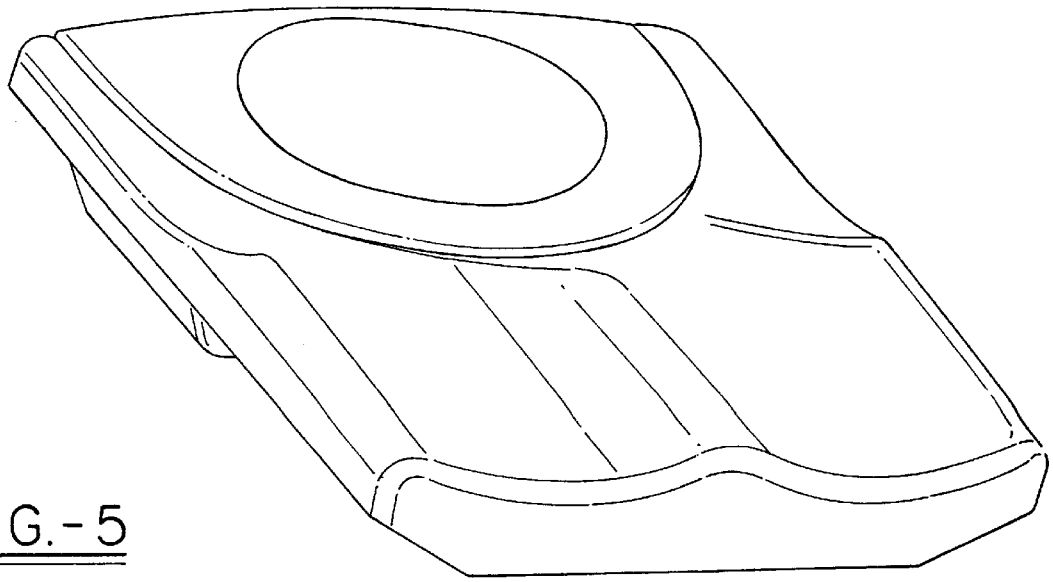
FIG. 5 is a top view of a second embodiment of the cushion assembly.
Figure 6:
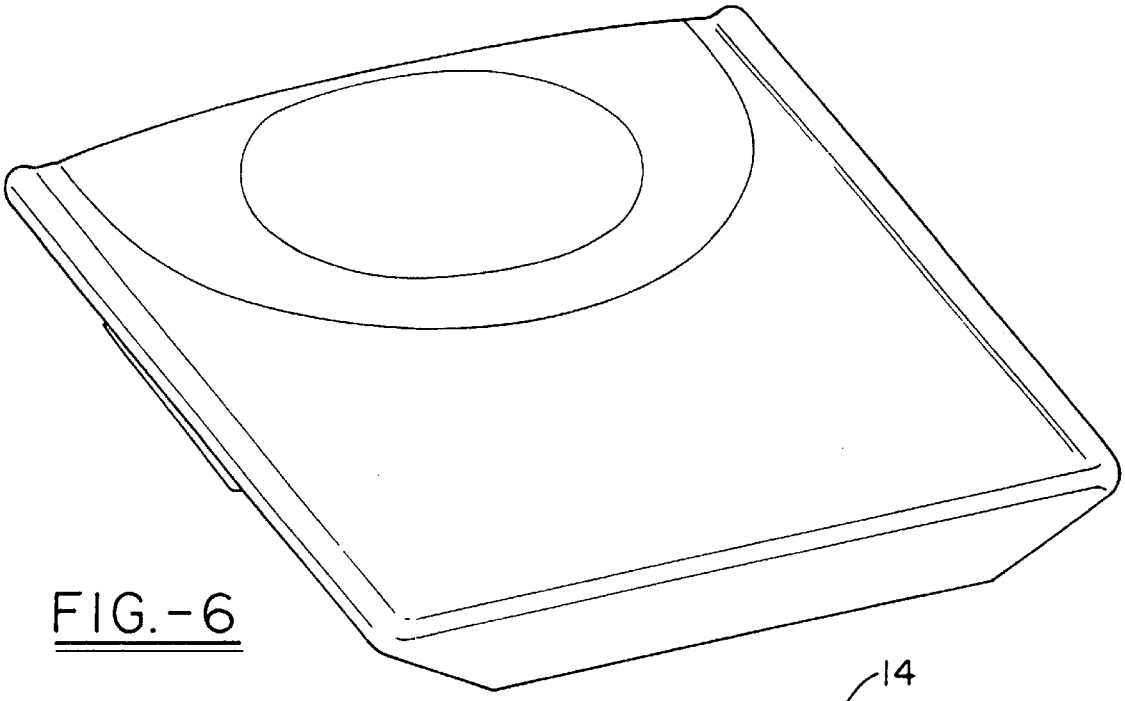
FIG. 6 is a top view of a third embodiment of the cushion assembly.
Figure 7:
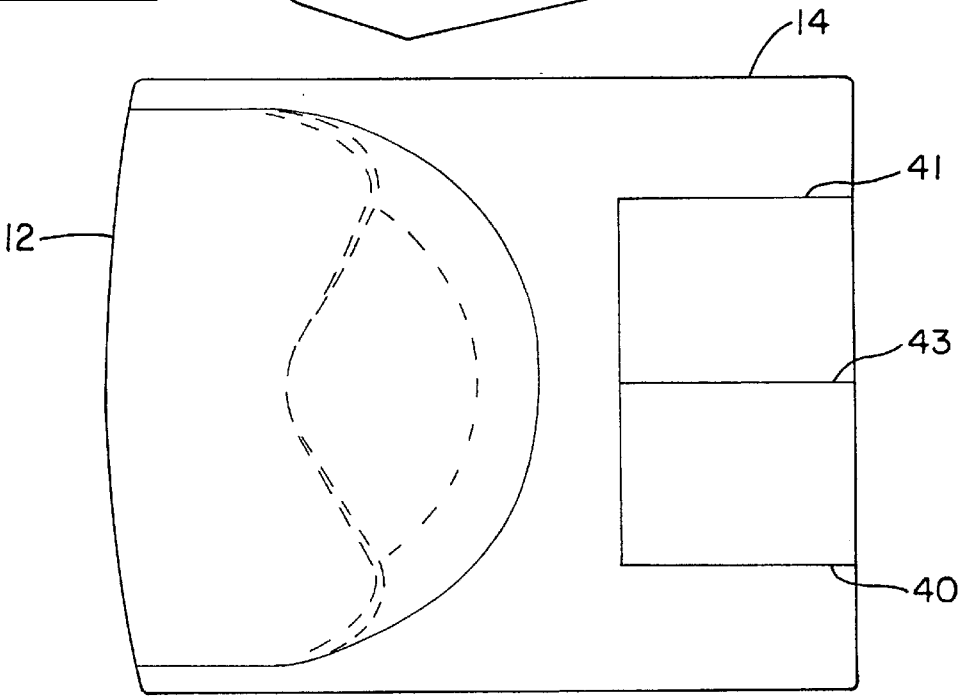
FIG. 7 is a top view of the base cushion of the invention showing the leg wedges.
Figure 8:
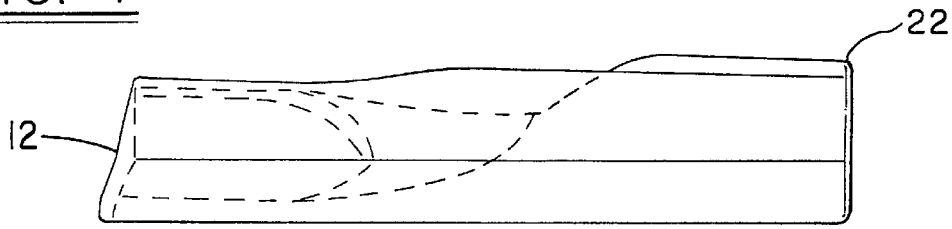
FIG. 8 is a side view of the base cushion of FIG. 7.
Figure 13:
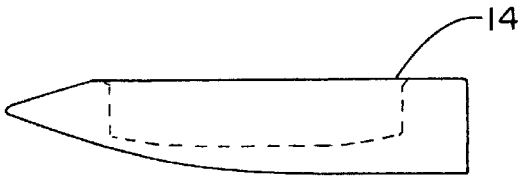
FIG. 13 is a side view of the intermediate insert.

The depression 18 the in base member is generally an arc where the depth of the depression is approximately three inches and the shape is defined by a radius of about 14 inches. Other curved rounded shapes may also be acceptable. The depression may be open to the rear as shown, or may include a closure for example for rearward positioning of the intermediate insert 14. The intermediate insert 14 may be made of a foam having compression characteristics similar to the base cushion 12 or depending on the application may be somewhat firmer or less firm. The cushion has a bottom curve 44 corresponding generally to the shape of the base cushion 12. The intermediate cushion 14 also includes a positioning well 16 which is generally a rounded configuration such as a hemispherical shape. As is illustrated, the shape does not correspond exactly to the bottom of insert 14 as the side walls 46 of the intermediate insert 14 are thicker at the top than the cross-section of the bottom of the insert. The intermediate insert 14 contains a cushioning insert 50 which generally has a rounded bottom and a top which can be relatively plane or contoured depending on part on the material from which it is constructed. The rounded bottom conforms generally to the shape of the positioning well 16. Various inserts are provided in accordance with several embodiments of the present invention. FIGS. 4 and 5 illustrate the use of the present invention such as for corrective positioning. In accordance with the present invention, the cushion insert is shaped so as to fit rather closely under the seat bones of a hypothetical user. This "hypothetical user" is a person constructed of the average dimensions of a wide variety of potential users so as to maximize the ability of the insert to fit the average population. It should be understood that various sizes can be provided to accommodate a variety of such "hypothetical" individuals. Thus, the seating assembly can be sized for children, small individuals, medium individuals and larger individuals, for example. In general, however, the width of the insert in a transverse direction will be from about 9 to about 14, and more particularly from about 10 to about 12 inches while the length, i.e. in the direction corresponding to the longitudinal axis of the seat, is from about 5 to about 12, more particularly from about 8 to about 10 inches.

Both the position of the cushioning insert 50 in the positioning well 16 and the position of the intermediate insert 14 in the depression 18 can be varied according to the needs of the user. In accordance with the present invention, the cushioning insert 50 is used for placement of the ischial tuberosities of the user while the trocantor extend on to the intermediate insert. Thus, the intermediate insert or base cushion are actually used to interact with the soft tissue, i.e. muscles of the wheelchair user. FIG. 4 illustrates the first position of the cushioning insert 50 relative to the positioning well, while FIG. 5 illustrates a second position where over time, the inserts could be shifted relative to one another in order to correct a spinal curvature or compensate for other changes in the user.

The base cushion 12 is a generally compressible material such as a closed or open cell foam preferably open cell polyurethane having a density 1–5 pounds per foot$^3$ and an IFD of about 20–70 pounds, and which is generally formed by molding or sculpting. Leg wedges 40, 41 are generally comprised of a more rigid material such as for example. Polyethylene, having a durometer of 30–70 Shore A. These wedges may be made by suitable techniques such as for example molding. The intermediate insert 14 may be made of a compressible material similar to the base 12; however, it is preferable that it is softer and thus has the IFD of about 20–50 pounds or an IFD which is about 20 pounds less than the base. Various cushioning inserts 50 can be used including for example foam, fluid or air bags or gel. Cushioning inserts should have the characteristics of providing for softer cushioning beneath the ischial tuberosities in order to avoid the formation of decubitus ulcers in this area. In this regard, it is important that the insert is so designed to avoid "bottoming out". This occurs when the cushioning material is pushed away from the seat bone such that the bone sits relatively directly on the base cushion, or in the case, on intermediate insert 14.

Figure 14:
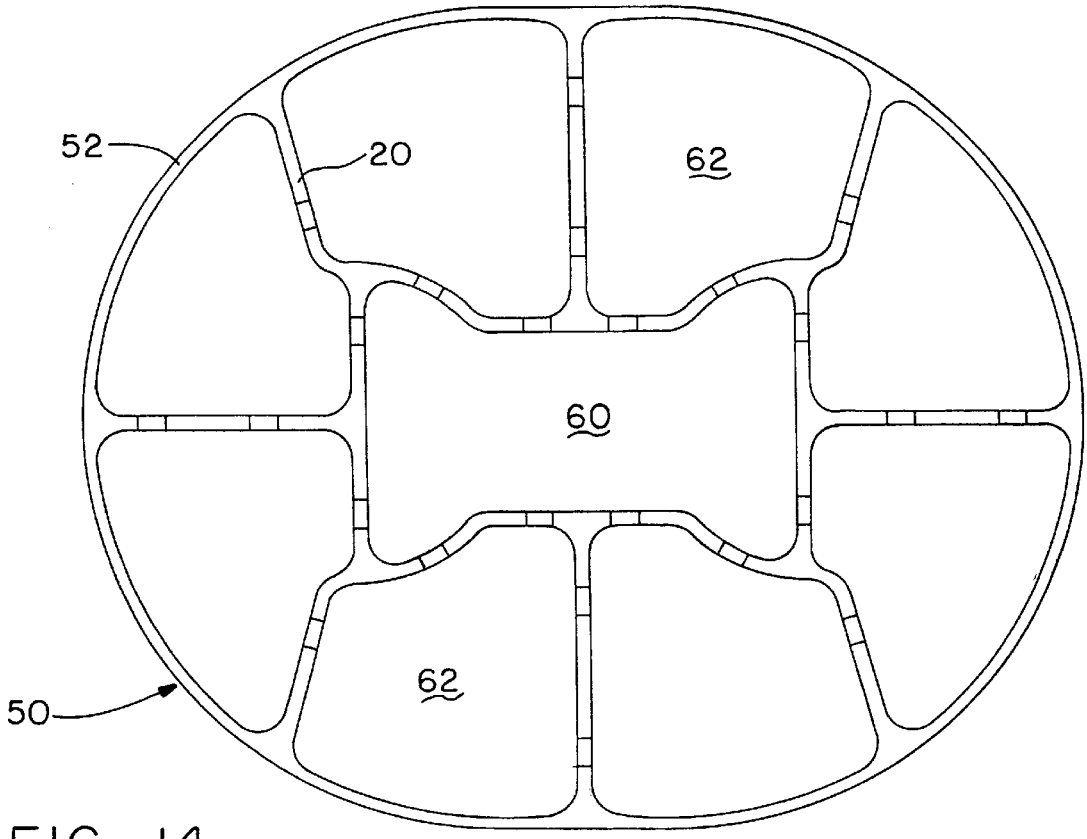
FIG. 14 is a top view of an air insert in accordance with the invention.
Figure 15:
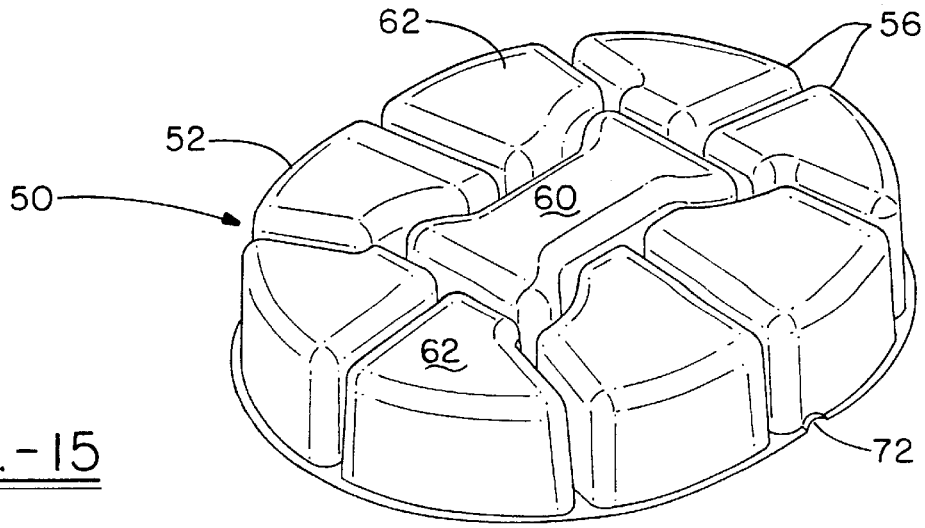
FIG. 15 is a side view of the air insert shown in FIG. 14.

FIGS. 14 and 15 illustrate a first cushioning insert 50 of the current invention. More particularly, this cushioning insert is an air cushion 52 comprised of a generally pad shaped member having internal baffles 54 which define chambers 56, which may be isolated from one another or which may be inner connected. Preferably, however, the chambers which correspond with the location of the seating bones, in this case illustrated as a singular dog-boned shaped chamber 60, are isolated so as to avoid bottoming in this region. Outward radial chambers 62 provide for further cushioning of this area. It is essential in the invention to provide for proper cushioning under the seat bones to best avoid the formation of decubitus ulcers. As can be seen in the cross-section, the air cushion 52 generally has a top and bottom mirror image formed so as to define chambers having side walls 64 as well as a top cushion area 68 and intermediate sealing portions 70. Appropriate air fill means can be used such as a check valve fill tube illustrated at 72. The cushion generally has a depth of about two inches and is filled to a pressure as is dictated by the therapist. A suitable material for constructing the top and bottom walls is 20 to 60 mil polyurethane film which has been molded to the characteristics described.

Figure 16:
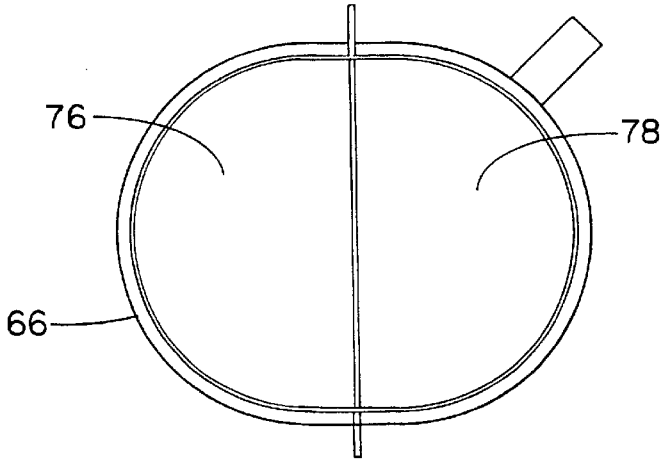
FIG. 16 is a top view of a fluid bag insert in accordance with another embodiment of the invention.
Figure 17:
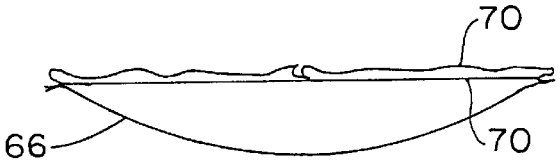
FIG. 17 is a side view of the fluid bag of FIG. 16.
Figure 18:
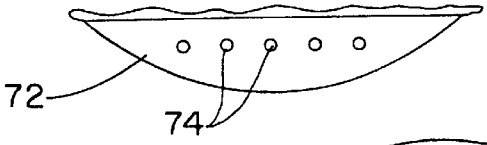
FIG. 18 illustrates the central baffles of the fluid bag.

FIGS. 16–18 illustrate a second embodiment of cushioning insert 50 which can be used in accordance with the invention. This insert 66 is a fluid bag type insert in which a generally hollow bag or envelope is formed of a flexible material, for example, one or two plies of polyurethane film at 5 to 20 mil having a generally round or oval top shape and being sealed such as by heat sealing around the outer periphery so as to form the envelope 68. In this case, the fluid bag 66 is shown as having a double ply of film 70 to inhibit the potential for rupture. The bag 66 further includes a central baffle 72 having intermediate apertures 74 which allow for fluid communication between a first and second chamber 76, 78. In this instance, the fluid bag 66 is shown with a right and left chamber again to provide for the right and left seat bone although it would also be possible to provide for multiple chambers. A suitable fluid is used having the desired flow characteristics having the desired flow characteristics such that the bag generally will flow under pressure but will maintain its shape in the absence of pressure. An example of a suitable material is.Flowlite.

Figure 19:
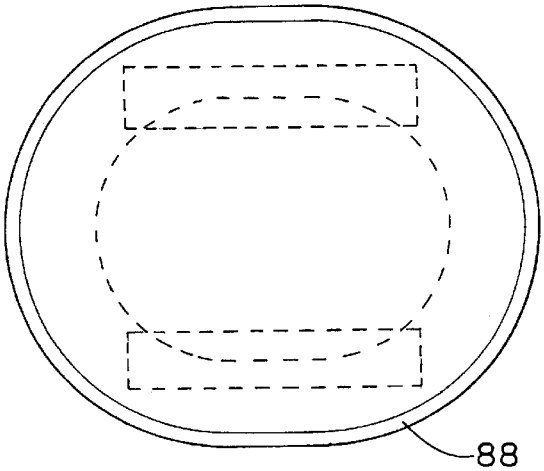
FIG. 19 is a top view of a foam insert in accordance with another embodiment of the invention.
Figure 20:
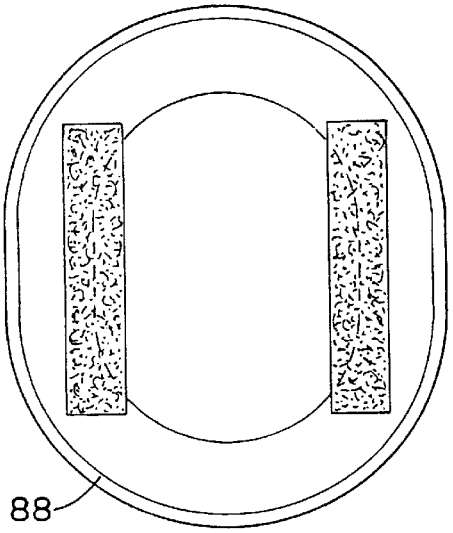
FIG. 20 is a bottom view of the foam insert.
Figure 21:
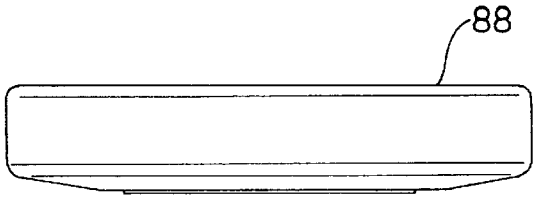
FIG. 21 is a side view of the foam insert.
Figure 22:
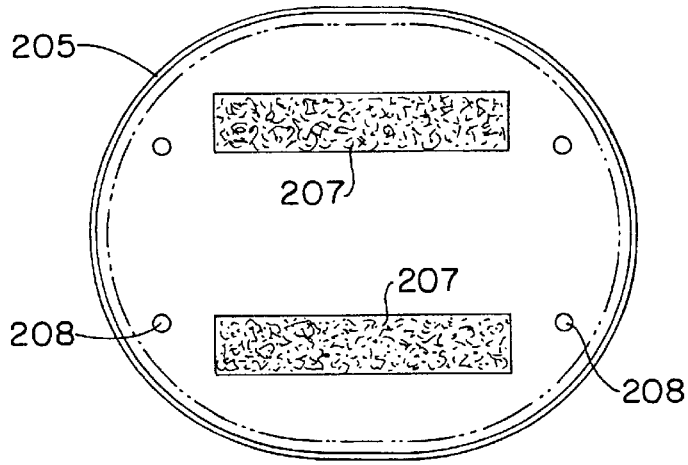
FIG. 22 is a top view of a gel/foam insert in accordance with another embodiment of the invention.
Figure 23:
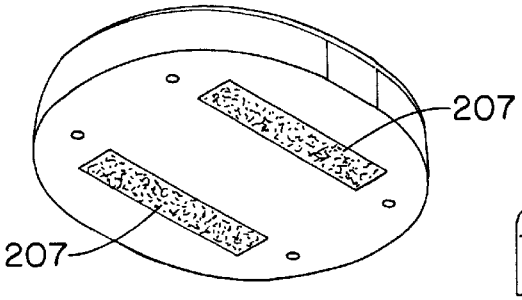
FIG. 23 is a perspective of the gel/foam insert of FIG. 22.
Figure 24:
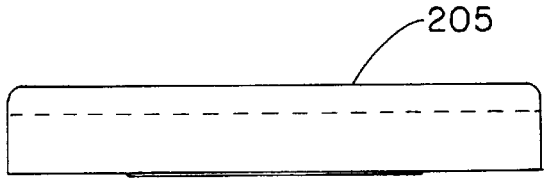
FIG. 24 is a side view of the gel/foam insert.
Figure 25:
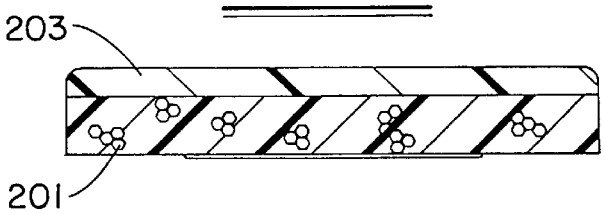
FIG. 25 is a cross sectional view of the gel/foam insert.
Figure 26:
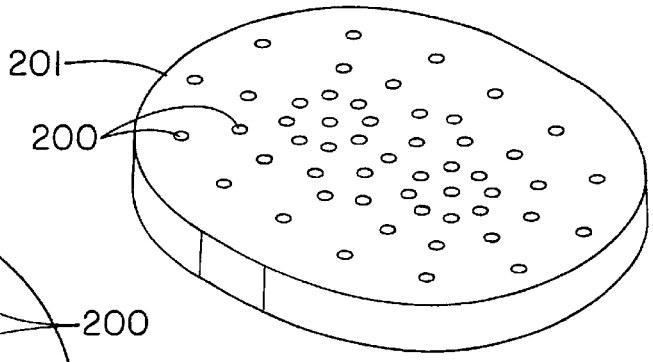
FIG. 26 is a perspective of the foam portion of the gel/foam insert.
Figure 27:
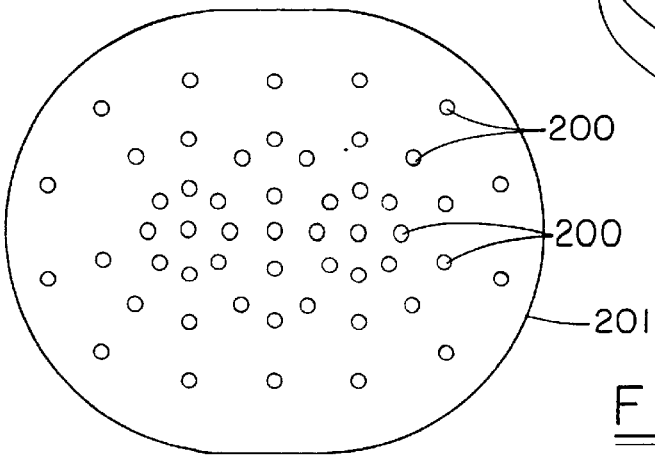
FIG. 27 is a top view of the foam portion of the gel/foam insert.

FIGS. 19–21 illustrates a third embodiment of the invention which is generally an ovoid shaped foam cushion 88, which is made of a material so as to have the consistent compression characteristics.

FIG. 11 illustrates a gel type cushion 84 in accordance with the invention. Once again, the gel cushion has a generally ovoid shape and has a shaped bottom as is illustrated for the other cushioning inserts 50. The cross-section of the gel can be uniform, or as illustrated, can comprise a foam 201 portion preferably having hollow upright channels 200. More channels are located by the ischial-tuberosities with a lower density of channels toward the outside. Alternatively, the channels can have a larger diameter in the internal portion of the cushion. The foam insert also includes a layer of gel 203. The assembly is encased in 3–10 mil polyurethane film 205 which is heat sealed about the assembly. The bottom surface includes hook in loop fastening members 207. The film 205 includes a plurality of vents 208 or holes to relieve air pressure from the bag.

In general the assembly is encased in a cover which is moisture impermeable and is stretchable to avoid "hammocking" of the cover. The cover can be opened to the bottom and include an elastic member which secures it around the base, or can be a more traditional cushion cover which has a zip opening. The inserts such as the pressure pads, intermediate inserts or wedges, can be adhered or affixed to the base cushion or other component such as by hook and loop fasteners or glue, or in the case of appropriate materials such as an open foam, friction may be sufficient to hold the components in place relative to each other.

Figure 28:
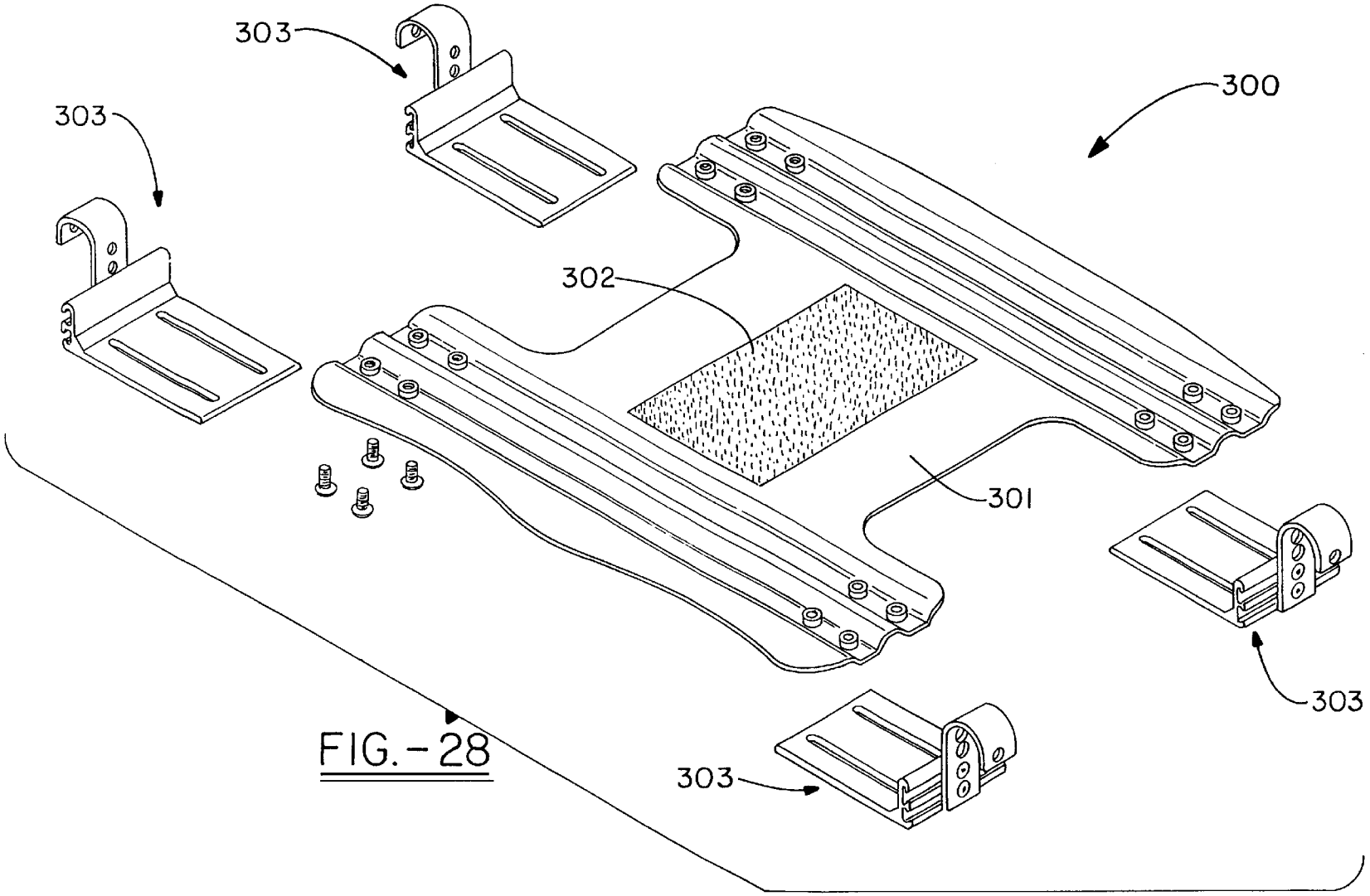
FIG. 28 is an exploded view of the drop base assembly for use with the cushion assembly of the present invention.

FIG. 28 illustrates a drop base assembly 300 having a relatively planar surface 301 with hook in loop 302 to enable the cushion to be used with certain wheelchairs. Mounting hardware 303 holds the base assembly 300 to the chair frame.

While in accordance with the Patent Statues, the best mode and preferred embodiment have been set forth, the scope of the invention is not limited thereto, but rather by the scope of the attached claims.

What is claimed is:

1. A cushion assembly comprising;

a compressible base cushion having a front and a back with a longitudinal axis extending in a direction from said front to said back and a cushioning insert, said base cushion defining a rear depression which accommodates a cushioning insert, said rear depression having a substantially concave shape;

said cushioning insert having a bottom with a substantially convex shape; and at least one tapered wedge which increases in depth in the direction of said longitudinal axis and having a generally constant cross-section in a direction transverse to the longitudinal axis.

2. An assembly as set forth in claim 1, wherein the top surface of said insert is substantially flat.

3. An assembly as set forth in claim 1, wherein said cushioning insert has a lateral dimension transverse to said axis which does not exceed about 14 inches, and a thickness transverse in a second direction where the maximum thickness of said insert is at least about one inch.

4. An assembly as set forth in claim 3, wherein said cushioning insert comprises a fluid filled bag.

5. An assembly as set forth in claim 1, wherein said cushioning insert is comprised of one or more of an air bag, gel, or foam.

6. A seating assembly for use in a wheelchair comprising;

a base cushion having a front and a back and a longitudinal axis extending from said front to said back, and said base cushion further having a first seating depression;

an insert having a bottom surface having at least a portion corresponding generally in shape to said seating depression and having a top surface defining a seating well of a size to accommodate substantially only the ischial tuberosities of a person capable of being seated in the wheelchair;

a compression insert in said seating well; and at least one tapered wedge which increases in depth in the direction of said longitudinal axis and having a generally constant cross-section in a direction transverse to said longitudinal axis.

7. A seating assembly as set forth in claim 6, wherein the base cushion is compressible and the insert is more compressible than the base cushion.

8. A seating assembly as set forth in claim 7 wherein said base cushion has a generally planar bottom surface separating reverse inclines at either lateral edge of said base cushion and at least two opposing lateral supports each made of a material relatively more rigid than the base cushion having a bottom surface so as to complete together the planar surface of said base cushion and a top surface which each compliments one of the reverse inclines of the base cushion.

9. A seating assembly as set forth in claim 8, wherein said lateral supports extend generally from the front of the base cushion to the back of the base cushion.

10. A seating assembly as set forth in claim 9, wherein said lateral supports are adhered to the base cushion.

11. A seating assembly for use in a wheelchair comprising;

a compressible base cushion having a front and a back and a longitudinal axis extending from said front to said back, and said base cushion further having a first seating depression;

an insert having a bottom surface corresponding generally in shape to said seating depression and having a top surface defining a seating well;

a compression insert in said seating well which comprises one or more of a gel insert, a foam insert, or a fluid filled insert; and at least one tapered wedge which increases in depth in the direction of said longitudinal axis, and having a generally constant cross-section in a direction transverse to said longitudinal axis.

12. A seating assembly as set forth in claim 11, wherein said base cushion has a generally planer bottom surface separating reverse inclines at either lateral edge of said base cushion and at least two opposing lateral supports each made of a material relatively more rigid than the base cushion having a bottom surface so as to complete together the planer surface of said base cushion and a top surface which each compliments one of the reverse inclines of the base cushion.

13. A seating assembly as set forth in claim 12, wherein said lateral supports extend generally from the front of the base cushion to the back of the base cushion.

14. A seating assembly as set forth in claim 13, wherein said lateral supports are adhered to the base cushion.

* * * * *